United States Patent [19]

Mochizuki et al.

[11] 4,435,962

[45] Mar. 13, 1984

[54] REFRIGERATING APPARATUS

[75] Inventors: Taketoshi Mochizuki, Shimizu; Kazuya Matsuo, Ibaraki; Mituo Kudo, Shimizu; Akira Arai, Ibaraki; Junichi Yamada, Itami; Keizi Shono, Toyonaka; Masaaki Aoki, Amagasaki; Masaichi Ohmori, Hachioji; Genichiro Nishi, Sagamihara, all of Japan

[73] Assignees: Shin Meiwa Industry Co., Ltd.; Hitachi, Ltd., both of Tokyo, Japan

[21] Appl. No.: 276,192

[22] Filed: Jun. 22, 1981

[30] Foreign Application Priority Data

Jun. 20, 1980 [JP] Japan ..... 55-82871

[51] Int. Cl.[3] ..... F25B 7/00; F25B 41/00

[52] U.S. Cl. ..... 62/175; 62/199; 62/510

[58] Field of Search ..... 62/175, 199, 510, 526, 62/196 A, 198, 217

[56] References Cited

U.S. PATENT DOCUMENTS

| | | | |
|---|---|---|---|
| 1,858,517 | 5/1932 | Marshall | 62/217 X |
| 2,082,549 | 6/1937 | Philipp | 62/198 |
| 2,222,239 | 11/1940 | Philipp | 62/526 X |
| 2,423,386 | 7/1947 | Hubacker | 62/510 X |
| 2,585,908 | 2/1952 | Backstrom . | |

FOREIGN PATENT DOCUMENTS

| | | | |
|---|---|---|---|
| 47-6927 | 8/1972 | Japan . | |
| 872336 | 7/1961 | United Kingdom | 62/510 |

*Primary Examiner*—William E. Wayner

*Attorney, Agent, or Firm*—Antonelli, Terry & Wands

[57] ABSTRACT

A refrigerating apparatus including a first compressor, a condenser, a first pressure reducer a first evaporator, a second pressure reducer and a second evaporator connected together by lines to form a refrigerating circuit for a refrigerant to flow therethrough, wherein a second compressor is connected at its suction side to the second pressure reducer for receiving gaseous component of refrigerant from the first evaporator and connected at its discharge side to the line between the first compressor and the condenser. An evaporative pressure control valve may be mounted in the line between the first evaporator and the second pressure reducer or the line between the second pressure reducer and the second evaporator. A bypass line mounting an electromagnetic valve may connect the line between the first evaporator and the second pressure reducer to the line between the second pressure reducer and the second evaporator.

4 Claims, 4 Drawing Figures

REFRIGERATING APPARATUS

BACKGROUND OF THE INVENTION

This invention relates to a refrigerating apparatus which is provided with two coolers or evaporators and adopts a double-stage evaporation system.

In a single-stage compression type refrigerating apparatus including a compressor, a condenser, a pressure reducing means and a cooler (evaporator) connected to one another in the indicated order to form a refrigerating circuit through which refrigerant flows, the quality of the refrigerant at the inlet of the cooler increases when the evaporative temperature becomes low. Thus, the latent heat of evaporation which has the function of cooling is reduced in amount and the specific volume of the refrigerant, in a gaseous state drawn into the compressor, and compression ratio of the refrigerant by the compressor increase thereby decreasing the coefficient of performance.

In order to eliminate this disadvantage, a double-stage compression system is adopted when the evaporative temperature is below about −40° C. to provide improvements in the quality of the refrigerant at the inlet of the cooler and the compression ratio. However, a single-stage compression system is still adopted for refrigerating apparatus wherein the evaporative temperature is about −40° C. or over −40° C.

In single-stage compression type refrigerating apparatus used in this temperature range, a refrigerating apparatus of the double-stage evaporation system provided with a deep-freeze compartment and a cold storage compartment is known which includes two coolers (evaporators) of different evaporating temperatures.

A two-temperature type refrigerating apparatus, as described in the specification and shown in FIG. 2 of Japanese Utility Model Publication No. 26927/72, comprises a compressor, a condenser, a first pressure reducing means, a first cooler, a second pressure reducing means, and a second cooler connected in series with one another in the indicated order to provide a refrigerating circuit, wherein the refrigerant in the first cooler has a higher evaporative temperature than the refrigerant in the second cooler. This refrigerating circuit might be faced with the problem that difficulties are experienced in regulating the distribution of the refrigerant in a liquid state to the first cooler and the second cooler, so that the cooling ability of each cooler might become too large or too small to cope with a variation in cooling load. Another problem that might arise is that the suction pressure of the compressor is substantially as low as the pressure in the second cooler in spite of the pressure in the first cooler being high.

SUMMARY OF THE INVENTION

The object of the present invention is to provide an improved refrigerating apparatus of the double-stage evaporation type having a first evaporator or cooler and a second evaporator or cooler connected in series, wherein refrigerant in a liquid state is supplied in sufficient amounts to the first cooler where a portion of the refrigerant is evaporated to perform cooling function, gaseous refrigerant produced in the first cooler is removed from refrigerant flowing out of the first cooler by a compressor at the same pressure as the evaporative pressure in the first cooler and only a refrigerant in a liquid state is supplied to the second cooler, whereby the cooling ability is increased and the coefficient of performance of the refrigerating apparatus is increased.

To attain the abovesaid object, the present invention has the features that refrigerant in a liquid state which has been prepared by condensing gaseous refrigerant fed from a first compressor to a condenser, has its pressure reduced by a first pressure reducing means and is fed to a first cooler to perform a cooling function, gaseous component in the refrigerant flowing out of the first cooler is drawn by suction into a second compressor while the remaining liquid component is fed through a second pressure reducing means to a second cooler to perform a cooling function at the second cooler, gaseous refrigerant flowing out of the second cooler is returned to the first compressor and gaseous refrigerant discharged from the second compressor is joined to the gaseous refrigerant discharged from the first compressor.

As aforesaid, the refrigerating apparatus according to the invention is provided with two coolers of different evaporative temperatures. The objective to be cooled as much as possible is first cooled by the first cooler of higher evaporative temperature, and the liquid refrigerant is separated from the gaseous refrigerant and led to the second cooler, so that the pressure loss that would occur therein can be reduced and thermal conductivity can be improved. As a result, the objective to be cooled can be cooled to a predetermined temperature at the first and second coolers and kept at such temperature level. Meanwhile, the gaseous refrigerant separated from the liquid refrigerant is extracted without performing a cooling action by the second compressor at a pressure higher than the suction pressure of the first compressor, so that the coefficient of performance can be greatly increased.

There is no risk of the liquid refrigerant being returned to the second compressor even if a reduction in cooling load decreases the temperature differential between the evaporative temperature of the first cooler and the temperature of the object to be cooled and reduces the amount of heat exchanged.

The aforesaid double-stage evaporation type refrigerating apparatus can be used in a refrigerating system provided with a deep-freeze compartment and a cold storage compartment. In this case, the second cooler is located in the deep-freeze compartment and the first cooler is located in the cold storage compartment.

In the refrigerating apparatus of the aforesaid construction, the evaporative temperature of the first cooler is kept substantially constant during operation, to keep the objective to be cooled at a suitable temperature. In an embodiment of the present invention, an evaporative pressure control valve may be mounted at the outlet of the first cooler or the suction conduit of the second compressor. The provision of this valve enables the evaporative temperature of the first cooler to be kept constant with increased accuracy.

In another embodiment, a bypass passage mounting an electromagnetic valve may be connected in parallel with the second pressure reducing means. In this embodiment, when no heat exchange takes place in the first cooler due to a reduction in cooling load, the second compressor is shut down and the electromagnetic valve is opened, to thereby effect capacity control during operation to keep the first cooler and the second cooler at the same evaporative pressure.

In still another embodiment, the aforesaid refrigerating apparatus can have application in a refrigerated open display cabinet. In this application, the first cooler is located in the cooling air passage on the upstream side of the air current and the second cooler is located therein on the downstream side thereof. This embodiment can be operated with a high degree of operation efficiency and enables the number of defrosting operations to be reduced, because the first cooler removes, in the from of water, most part of the latent heat component of the total heat to be removed and the second cooler reduces the temperature of the dehydrated air to a desired level.

DESCRIPTION OF THE PREFERRED EMBODIMENTS

Figure 1:
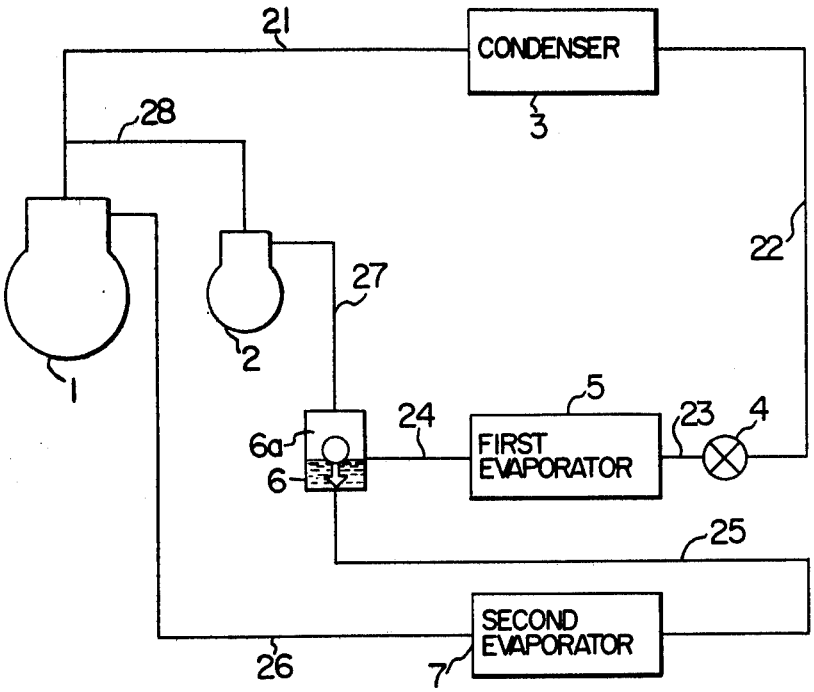
FIG. 1 is circuit diagram for refrigerant comprising one embodiment of the invention.

Referring to FIG. 1, a first refrigerant compressor (hereinafter referred to as a first compressor) 1 is connected at its discharge side through a discharge line 21 to a condenser 3 having connected to its outlet a line 22 mounting a first pressure reducing means 4. The first pressure reducing means 4 is connected at its outlet through a line 23 to a first cooler (first evaporator) 5 connected at its outlet through a line 24 to a float valve 6. The float valve 6 is connected at its outlet at the lower end thereof to a second cooler (second evaporator) 7 through a line 25. The second cooler 7 is connected at its outlet to the suction side of the first compressor 1 through a line 26, to thereby complete a refrigeration circuit. The float valve 6 includes a valve chamber 6*a* connected at its upper portion through a line 27 to a suction side of a second refrigerant compressor (hereinafter referred to as a second compressor) 2 which is connected at its discharge side to the discharge line 21 of the first compressor 1 through a line 28. The float valve 6 functions to separate liquid refrigerant and gaseous refrigerant from each other. In addition, the float valve 6 functions as a pressure reducing means (second pressure reducing means) because of the small diameter of the valve outlet passage.

The refrigerating apparatus of the aforesaid construction operates as follows. Gaseous refrigerant of high temperature and high pressure discharged from the first compressor 1 is introduced through the line 21 into the condenser 3 where the gaseous refrigerant changes into a liquid refrigerant which flows through the line 22 into the first pressure reducing means 4 where its pressure is reduced, and the refrigerant flows through the line 23 into the first cooler 5 to perform a cooling action. The refrigerant at the outlet of the cooler 5 consists of gaseous refrigerant mingled with a large amount of liquid refrigerant because the cooler 5 serves as a liquid filled type cooler. The liquid refrigerant is separated from the gaseous refrigerant by the float valve 6 and led through the line 25 to the second cooler 7 after having its pressure reduced at the float valve 6. The liquid refrigerant performs a cooling function in the second cooler 7 and changes into a gaseous state before being returned to the suction side of the first compressor 1 through the line 26, thereby completing the refrigeration cycle. Meanwhile, the gaseous refrigerant collected in the upper portion of the valve chamber 6*a* of the float valve 6 is drawn by suction into the second compressor 2 through the line 27, and the refrigerant is discharged from the second compressor 2 through the line 28 after being compressed, so that the compressed gaseous refrigerant from the second compressor 2 joins the compressed gaseous refrigerant from the first compressor for circulation through the refrigeration circuit.

In the refrigerating apparatus of the aforesaid construction according to the invention, the objective to be cooled is cooled at two different evaporative temperatures at the two coolers 5 and 7. More specifically, cooling of the objective is effected as much as possible at the first cooler 5 at a higher evaporative temperature, and the refrigerant consisting of gaseous refrigerant and liquid refrigerant in mingling condition has its liquid component separated from its gaseous component at the float valve 6, to cause only the liquid component to flow to the second cooler 7. Thus, it is only the liquid refrigerant performing a cooling function that is passed to the second cooler 7, so that the pressure loss in the second cooler 7 is reduced and the heat conductivity is increased. The gaseous refrigerant separated from the liquid refrigerant that performs no cooling function is introduced into the second compressor 2 at a pressure higher than the suction pressure of the first compressor 1, thereby improving the coefficient of performance. When the load is reduced, the evaporative temperature of the refrigerant at the first cooler 5 and the temperature of the objective to be cooled might have their difference reduced and, consequently, the amount of heat exchanged at the first cooler 5 might be reduced. Even in this case, no liquid refrigerant flows into the line 27 because the line 27 is connected to the upper portion of the valve chamber 6*a* of the float valve 6, so that introduction of the liquid refrigerant into the second compressor 2 can be avoided. Since the opening of the first pressure reducing means 4 is controlled in response to the degree of superheat of the refrigerant flowing out of the second cooler, the refrigerant flowing into the second cooler 7 has its amount optimally controlled, so as to enable the second cooler 7 to optimally perform a cooling function.

In an application wherein the first cooler 5 of the refrigerating apparatus is located in a cold storage compartment and the second cooler 7 thereof is located in a deep-freeze compartment, the load of the first cooler 5 might be reduced and the load of the second cooler 7 might be increased. In this case, the amount of heat exchanged at the first cooler 5 is reduced and the gaseous refrigerant separated from the liquid refrigerant at the valve chamber 6*a* and introduced into the second compressor 2 is reduced in amount. However, the liquid refrigerant flowing through the float valve 6 is increased, so that the liquid refrigerant flows into the second cooler 7 in increased amount. Thus, the amount of heat exchanged at the second cooler 7 increases to conform to the prevailing condition of the load. Thus, the refrigeration circuit is controlled in such a manner that the first cooler 5 and second cooler 7 each suitably bear the load by adjusting the amount of heat exchanged at each cooler.

Figure 2:
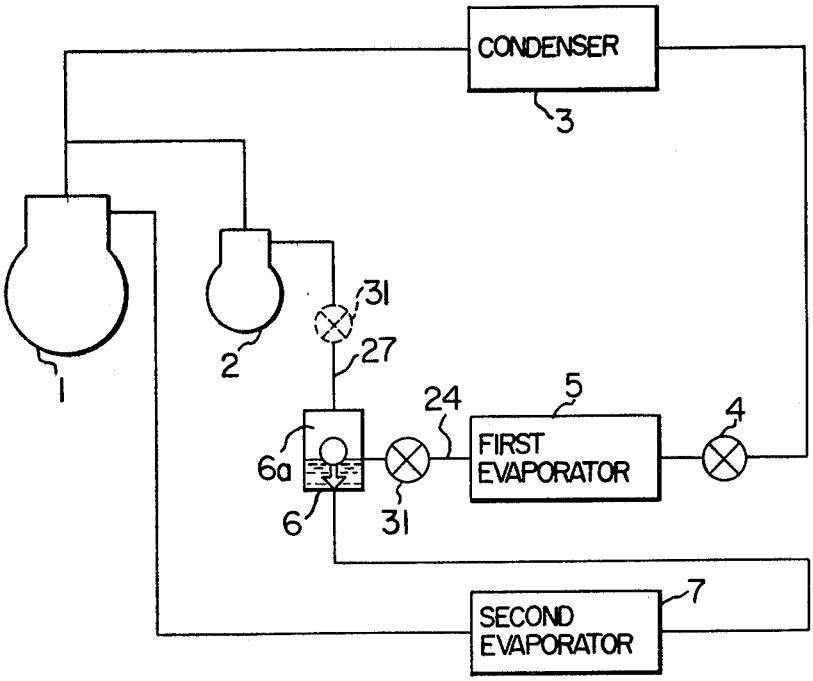
FIG. 2 is a circuit diagram for refrigerant having an evaporative pressure control valve comprising another embodiment of the invention.

FIG. 2 shows another constructional form, wherein an evaporative pressure control valve 31 is mounted in the outlet line 24 of the first cooler 5. The evaporative pressure control valve 31 may be mounted in the inlet line 27 of the second compressor 2 as shown in broken lines. By virtue of the evaporative pressure control valve 31, it is possible to keep constant the evaporative pressure of the first cooler 5 at all times. Other parts of the constructional form are similar to those of the constructional form shown in FIG. 1, so that they are designated by like reference characters and their description is omitted.

Figure 3:
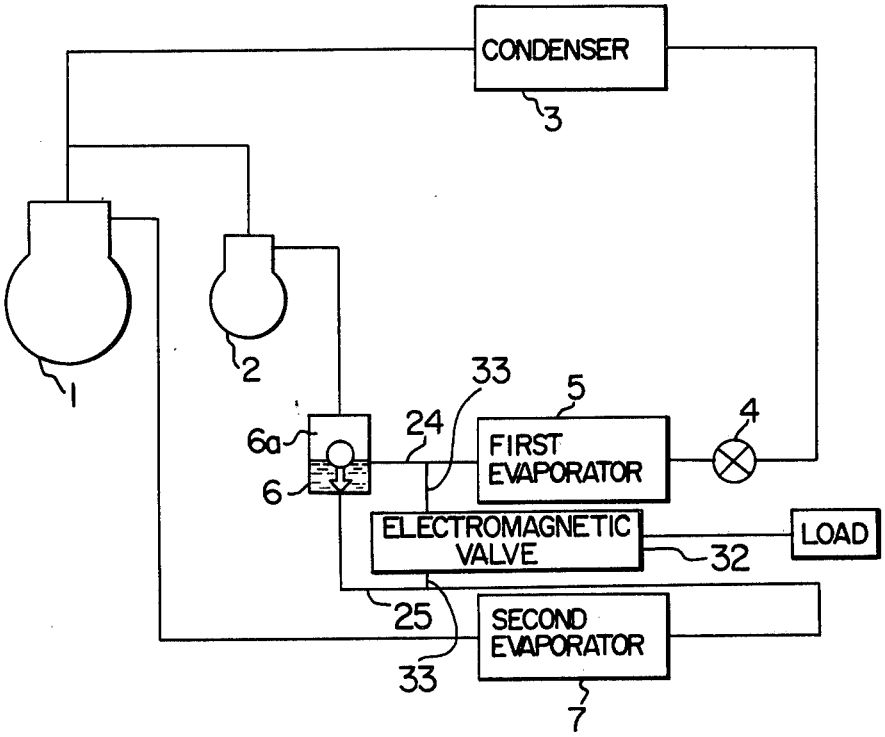
FIG. 3 is a circuit diagram for refrigerant having a bypass passage comprising still another embodiment of the invention.

FIG. 3 shows still another constructional form which is suitable for use in application wherein a reduction in load prevents heat exchange from taking place at the first cooler 5. If the load shows a reduction and heat exchange does not take place at the first cooler 5, the amount of heat required to be removed by cooling is naturally reduced. In this case, the second compressor 2 is shut down and the refrigerant is passed through a bypass line 33 mounting an electromagnetic valve 32 connecting the line 24 between the first cooler 5 and the float valve 6 to the line 25 between the float valve 6 and the second cooler 7. Other parts of the constructional form are similar to those of the constructional form shown in FIG. 1, so that they are designated by like reference characters and their description is omitted.

If the load shows a reduction and heat exchange does not take place at the first cooler 5, the amount of heat required to be removed by cooling is naturally reduced. In this case, the second compressor 2 is shut down and the electromagnetic valve 32 is opened, to allow the refrigerant from the first cooler 5 to bypass the float valve 6 and flow directly to the second cooler 7. That is, the first cooler 5 and the second cooler 7 are maintained in communication with each other, to keep the evaporative temperatures in the two coolers 5 and 7 at the same level. The opening of the first pressure reducing means 4 is controlled in accordance with the degree of superheat of the gaseous refrigerant released from the second cooler 7.

Figure 4:
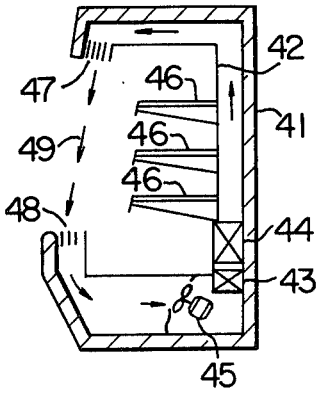
FIG. 4 is a sectional view of a refrigerated open display cabinet having the invention incorporated therein.

The double-stage evaporation system of the aforesaid construction may be used most advantageously in a refrigerated or cold storage open display cabinet, such as the one shown in FIG. 4. As shown, a show case body 41 has an inner case 42 provided with a plurality of shelves 46 arranged in superposed relation one above another, and a cooling air passage is defined between the inner wall surface of the body 41 and the outer wall surface of the inner case 42. An air issuing slit 47 is defined between the body 41 and inner case 42 at an upper end of a front opening of the body 41 and inner case 42, and an air drawing slit 48 is defined between the body 41 and inner case 42 at a lower end of the front opening, so that an air curtain 49 is provided between the air issuing slit 47 and the air drawing slit 48. A fan 45 is located in a bottom section of the cooling air passage, and a first cooler 43 (5) and a second cooler 44 (7) are located in a lower vertical portion of the cooling air passage. The first cooler and second cooler 43 and 44 constitute a refrigeration circuit as shown in FIG. 1. The air at 5° C. drawn through the air drawing slit 48 is cooled to about 0° C. as it passes through the first cooler 43 and then cooled to about −5° C., which is a necessary temperature, by the second cooler 44. The air cooled in this way flows through the cooling air passage and the air curtain 49 between the air issuing slit 47 and the air drawing slit 48. In this process, the cooling air has its temperature raised to about 5° C. again as it reaches the air drawing slit 48 by the heat entering the cooling air passage through the wall of the body 41 and through the air curtain 49. However, the air is cooled again as it flows through the first and second coolers 43 and 44, and this process is repeated, to cool the space in the display cabinet body 41. The evaporative temperature of the first cooler 43 is set at about −1° to −2° C., so that the latent heat component of the total heat to be removed can be removed in the form of water at the first cooler 43. Thus, it is possible to operate the cooling apparatus with a high degree of operation efficiency and to reduce the number of times a defrosting operation is performed.

What is claimed is:

1. A refrigerating apparatus comprising a closed refrigerant circuit including a first compressor, a condenser, a first pressure reducing means, a first evaporator, a second pressure reducing means and a second evaporator connected together through lines in the indicated order, said first evaporator is located in a cooling air passage on an upstream side thereof with respect to a direction of an air current flowing through said air passage, said second evaporator is located in the cooling air passage on a downstream side thereof, and a second compressor connected to said refrigerant circuit so that gaseous components of refrigerant in the line between an outlet of the first evaporator and the second pressure reducing means is lead to a suction side of the second compressor, a discharge line of the second compressor is in communication with a discharge line of said first compressor.

2. A refrigerating apparatus as claimed in claim 1, wherein said second pressure reducing means comprises a float valve having a valve chamber, said float valve being communicated at an upper portion of the valve chamber with the suction side of said second compressor.

3. A refrigerating apparatus comprising a closed refrigerant circuit including a first compressor, a condenser, a first pressure reducing means, a first evaporator, a second pressure reducing means, and a second evaporator connected together through lines in the indicated order, and a second compressor connected to said refrigerant circuit so that gaseous components of refrigerant in the line between an outlet of the first evaporator and the second pressure reducing means is lead to a suction side of the second compressor, and a discharge line of the second compressor is in communication with a discharge line of the first compressor, and a bypass line mounting an electromagnetic valve connecting the line from said first evaporator to said second pressure reducing means to the line from said second pressure reducing means to said second evaporator, said electromagnetic valve being opened in accordance with a load to maintain the first evaporator and the second evaporator in communication with each other.

4. A refrigerating apparatus as claimed in claim 3, wherein said second compressor is shut down when the electromagnetic valve is open and the load is reduced below a predetermined level.

* * * * *